US011380478B2

(12) United States Patent
Jang et al.

(10) Patent No.: US 11,380,478 B2
(45) Date of Patent: Jul. 5, 2022

(54) COIL COMPONENT

(71) Applicant: SAMSUNG ELECTRO-MECHANICS CO., LTD., Suwon-si (KR)

(72) Inventors: Su Bong Jang, Suwon-Si (KR); Hee Soo Yoon, Suwon-Si (KR); Sang Jong Lee, Suwon-Si (KR); Min Ki Jung, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 910 days.

(21) Appl. No.: 16/161,663

(22) Filed: Oct. 16, 2018

(65) Prior Publication Data

US 2019/0279813 A1 Sep. 12, 2019

(30) Foreign Application Priority Data

Mar. 9, 2018 (KR) ..... 10-2018-0028217
May 4, 2018 (KR) ..... 10-2018-0051913

(51) Int. Cl.
*H01F 27/36* (2006.01)
*H01F 17/00* (2006.01)
(Continued)

(52) U.S. Cl.
CPC ..... *H01F 27/361* (2020.08); *H01F 17/0013* (2013.01); *H01F 17/04* (2013.01);
(Continued)

(58) Field of Classification Search
CPC .. H01F 27/36; H01F 17/0013; H01F 27/2804; H01F 27/288
See application file for complete search history.

(56) References Cited

U.S. PATENT DOCUMENTS

2005/0253677 A1* 11/2005 Ito ..... H01F 17/0013 336/200
2016/0189863 A1* 6/2016 Park ..... H01F 17/04 29/602.1
(Continued)

FOREIGN PATENT DOCUMENTS

JP 2005-310863 A 11/2005
JP 4073682 B2 4/2008
KR 10-2017-0097299 A 8/2017

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes: a body having a first surface and a second surface opposing each other in one direction and including a core extending in the one direction; a coil portion embedded in the body and having at least one turn around the core; and an external electrode disposed at least on the first surface of the body and connected to the coil portion. A first distance from the coil portion to a third surface of the body is greater than a second distance from the coil portion to a fourth surface of the body. The third and fourth surfaces oppose each other and have the core disposed therebetween. Turns of the coil portion disposed between the third surface of the body and the core are more than those of the coil portion disposed between the fourth of the body and the core.

20 Claims, 6 Drawing Sheets

II-II'

(51) Int. Cl.

| | |
|---|---|
| ***H01F 27/28*** | (2006.01) |
| ***H01F 17/04*** | (2006.01) |
| ***H01F 27/29*** | (2006.01) |

(52) U.S. Cl.

CPC ..... *H01F 27/2804* (2013.01); *H01F 27/288* (2013.01); *H01F 27/292* (2013.01); *H01F 27/363* (2020.08); *H01F 27/366* (2020.08); *H01F 2017/008* (2013.01); *H01F 2017/048* (2013.01); *H01F 2027/2809* (2013.01)

(56) References Cited

U.S. PATENT DOCUMENTS

| | | | | |
|---|---|---|---|---|
| 2016/0240296 | A1* | 8/2016 | Kim | H01F 17/04 |
| 2017/0032883 | A1* | 2/2017 | Hong | H01F 27/292 |
| 2017/0110240 | A1* | 4/2017 | Masuda | H01F 17/0013 |
| 2017/0125153 | A1* | 5/2017 | Yoshioka | H01F 5/003 |
| 2017/0309576 | A1* | 10/2017 | Kawabata | H01L 25/16 |
| 2017/0338030 | A1* | 11/2017 | Miyahara | H01F 27/2885 |
| 2018/0166211 | A1* | 6/2018 | Takatsuji | H02M 3/156 |
| 2018/0315545 | A1* | 11/2018 | Kusumoto | H01F 27/36 |
| 2019/0189338 | A1* | 6/2019 | Kim | H01F 27/324 |
| 2019/0199310 | A1* | 6/2019 | Sato | H01F 17/0013 |
| 2019/0379343 | A1* | 12/2019 | Miyahara | H03H 1/00 |
| 2020/0082990 | A1* | 3/2020 | Yamamoto | H01F 27/363 |

* cited by examiner

COIL COMPONENT

CROSS-REFERENCE TO RELATED APPLICATION(S)

This application claims benefit of priority to Korean Patent Application Nos. 10-2018-0028217 filed on Mar. 9, 2018 and 10-2018-0051913 filed on May 4, 2018 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in an electronic device, together with a resistor and a capacitor.

In accordance with gradual performance improvement and size decrease of the electronic device, the number of electronic components used in an electronic device has increased, while sizes of such electronic components have been decreased.

For the reason described above, demand for removal of a noise generation source such as electromagnetic interference (EMI) of the electronic components has gradually increased.

In current general EMI shielding technology, electronic components are mounted on a board, and the electronic components and the board are then simultaneously surrounded by a shield can.

SUMMARY

An aspect of the present disclosure may provide a coil component in which a leaked magnetic flux may be decreased.

An aspect of the present disclosure may also provide a coil component in which magnetic fluxes leaked to opposite end surfaces are made uniform.

According to an aspect of the present disclosure, a coil component may include: a body having a first surface and a second surface opposing each other in one direction and including a core extending in the one direction; a coil portion embedded in the body and having at least one turn around the core; and an external electrode disposed at least on the first surface of the body and connected to the coil portion. A first distance from the coil portion to a third surface of the body may be greater than a second distance from the coil portion to a fourth surface of the body. The third and fourth surfaces may oppose each other and have the core disposed therebetween. Turns of the coil portion disposed between the third surface of the body and the core may be more than those of the coil portion disposed between the fourth surface of the body and the core.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
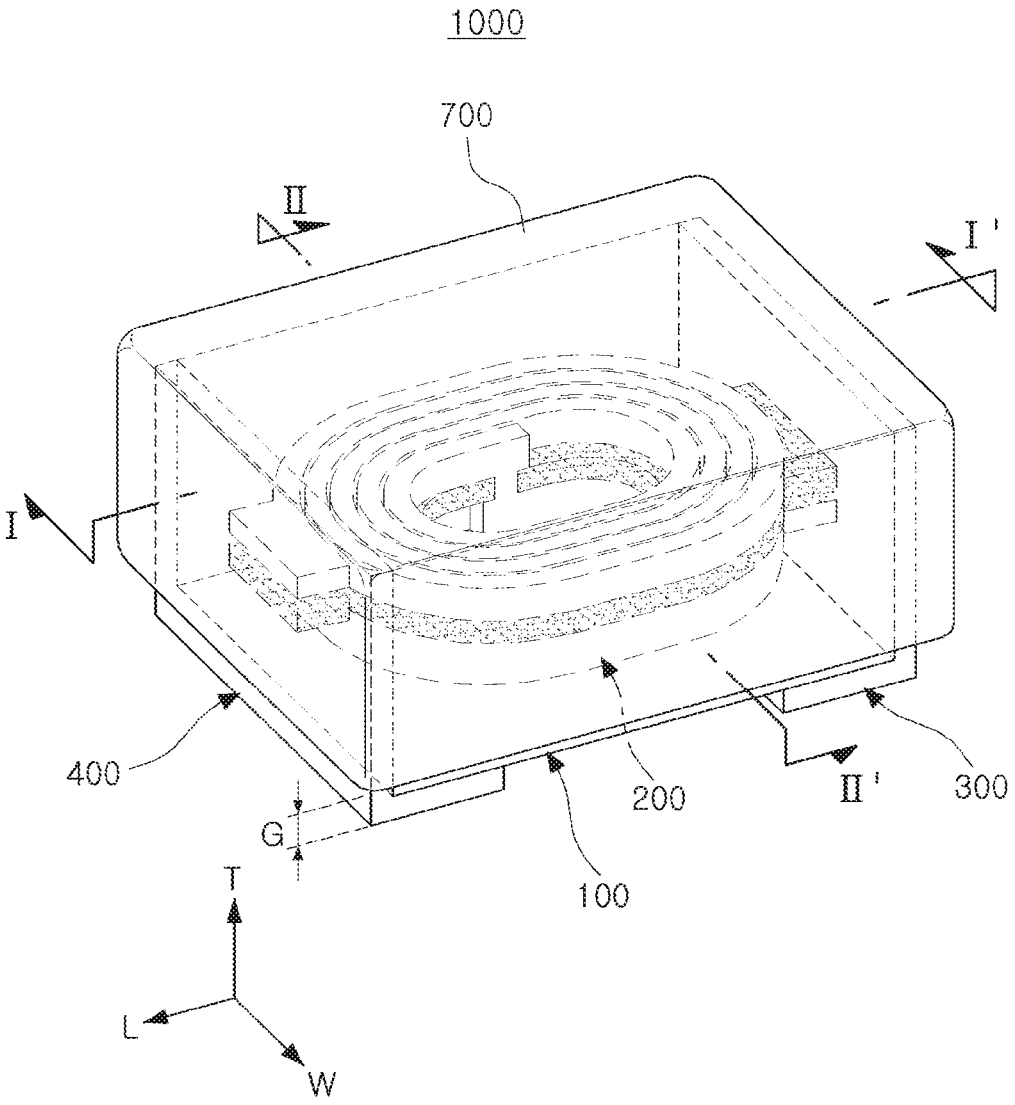
FIG. 1 is a schematic perspective view illustrating a coil component according to a first exemplary embodiment in the present disclosure.

Hereinafter, exemplary embodiments of the present disclosure will now be described in detail with reference to the accompanying drawings.

In the drawings, an L direction refers to a first direction or a length direction, a W direction refers to a second direction or a width direction, and a T direction refers to a third direction or a thickness direction.

Hereinafter, coil components according to exemplary embodiment in the present disclosure will be described in detail with reference to the accompanying drawings. In describing exemplary embodiments in the present disclosure with reference to the accompanying drawings, components that are the same as or correspond to each other will be denoted by the same reference numerals, and an overlapping description therefor will be omitted.

Various kinds of electronic components may be used in an electronic device, and various kinds of coil components may be appropriately used between these electronic components depending on their purposes in order to remove noise, or the like.

That is, the coil components used in the electronic device may be a power inductor, high frequency (HF) inductors, a general bead, a bead for a high frequency (GHz), a common mode filter, and the like.

First Exemplary Embodiment

Figure 2:
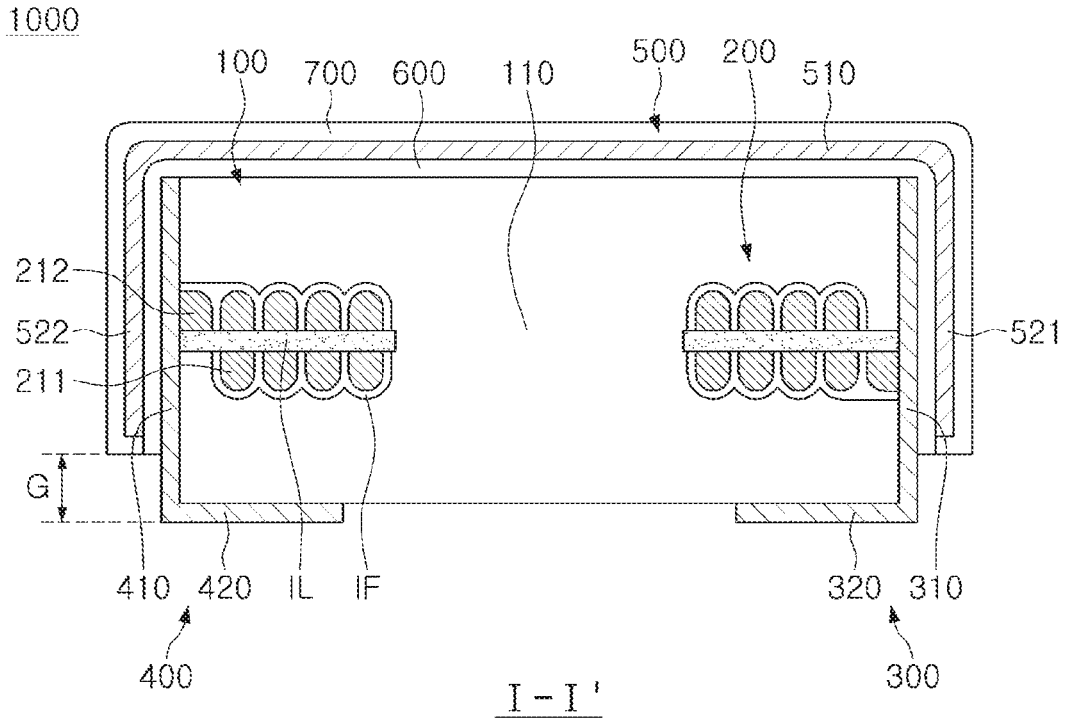
FIG. 2 is a cross-sectional view taken along line I-I' of FIG. 1.
Figure 3:
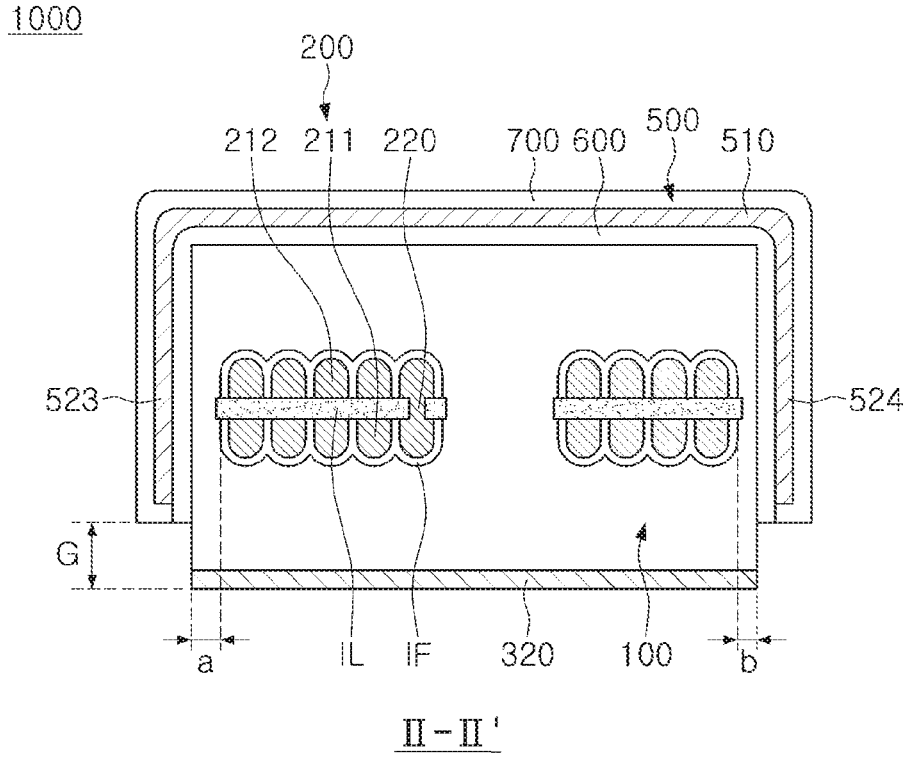
FIG. 3 is a cross-sectional view taken along line II-II' of FIG. 1.
Figure 4:
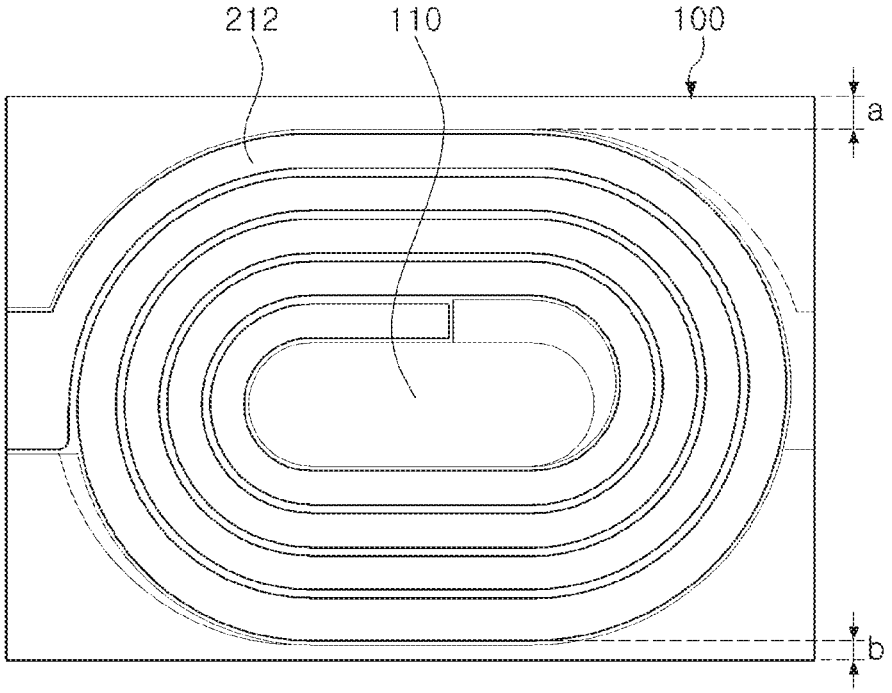
FIG. 4 is a plan view illustrating a coil portion.

FIG. 1 is a schematic perspective view illustrating a coil component according to a first exemplary embodiment in the present disclosure. FIG. 2 is a cross-sectional view taken along line I-I' of FIG. 1. FIG. 3 is a cross-sectional view taken along line II-II' of FIG. 1. FIG. 4 is a plan view illustrating a coil portion.

Referring to FIGS. 1 through 4, a coil component 1000 according to a first exemplary embodiment in the present disclosure may include a body 100, a coil portion 200, external electrodes 300 and 400, a shielding layer 500, an insulating layer 600, and a gap portion G, and may further include a cover layer 700, an internal insulating layer IL, and an insulating film IF.

The body 100 may form an appearance of the coil component 1000 according to the present exemplary embodiment, and may bury the coil portion 200 therein.

The body 100 may generally have a hexahedral shape.

A first exemplary embodiment in the present disclosure will hereinafter be described on the assumption that the body 100 has the hexahedral shape. However, such a description does not exclude a coil component including a body having a shape other than the hexahedral shape from the scope of the present exemplary embodiment.

The body 100 may have a first surface and a second surface opposing each other in the length direction (L), a third surface and a fourth surface opposing each other in the width direction (W), and a fifth surface and a sixth surface opposing each other in the thickness direction (T). The first to fourth surfaces of the body 100 may correspond to walls of the body 100 connecting the fifth and sixth surfaces of the body 100 to each other. The walls of the body 100 may include the first and second surfaces, which are opposite end surfaces opposing each other, and the third and fourth surfaces, which are opposite side surfaces opposing each other.

The body 100 may be formed so that the coil component 1000 according to the present exemplary embodiment in which external electrodes 300 and 400, an insulating layer 600, a shielding layer 500, and a cover layer 700 to be described below are formed may have a length of 2.0 mm, a width of 1.2 mm, and a thickness of 0.65 mm by way of example, but is not limited thereto. Meanwhile, the numerical values of the length, the width, and the thickness of the coil component described above, which are numeral values except for tolerances, may be different from actual numerical values of the length, the width, and the thickness of the coil component.

The body 100 may include magnetic materials and a resin. In detail, the body may be formed by stacking one or more magnetic composite sheets in which the magnetic materials are dispersed in the resin. However, the body 100 may also have a structure other than a structure in which the magnetic materials are dispersed in the resin. For example, the body 100 may be formed of a magnetic material such as ferrite.

The magnetic material may be ferrite or metal magnetic powder particles.

The ferrite may be, for example, one or more of spinel type ferrites such as Mg—Zn-based ferrite, Mn—Zn-based ferrite, Mn—Mg-based ferrite, Cu—Zn-based ferrite, Mg—Mn—Sr-based ferrite, or Ni—Zn-based ferrite, hexagonal ferrites such as Ba—Zn-based ferrite, Ba—Mg-based ferrite, Ba—Ni-based ferrite, Ba—Co-based ferrite, or Ba—Ni—Co-based ferrite, garnet type ferrite such as Y-based ferrite, Li-based ferrite.

The metal magnetic powder particles may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particles may be one or more of pure iron powder particles, Fe—Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metal magnetic powder particles may be amorphous or crystalline. For example, the metal magnetic powder particles may be Fe—Si—B—Cr based amorphous alloy powder particles, but are not necessarily limited thereto.

The ferrite and the metal magnetic powder particles may have average diameters of about 0.1 μm to 30 μm, respectively, but are not limited thereto.

The body 100 may include two kinds or more of magnetic materials dispersed in the resin. Here, different kinds of magnetic materials mean that the magnetic materials dispersed in the resin are distinguished from each other by any one of an average diameter, a composition, crystallinity, and a shape.

The resin may include epoxy, polyimide, liquid crystal polymer (LCP), or the like, or mixtures thereof, but is not limited thereto.

The body 100 may include a core 110 penetrating through a coil portion 200 to be described below. The core 110 may be formed by filling a through-hole of the coil portion 200 with the magnetic composite sheet, but is not limited thereto.

The coil portion 200 may be embedded in the body 100, and may implement characteristics of the coil component. For example, when the coil component 1000 is used as a power inductor, the coil portion 200 may serve to store an electric field as a magnetic field to maintain an output voltage, resulting in stabilization of power of an electronic device.

The coil portion 200 may include a first coil pattern 211, a second coil pattern 212, and a via 220.

The first coil pattern 211, the second coil pattern 212, and an internal insulating layer IL to be described below may be stacked in the thickness direction (T) of the body 100.

Each of the first coil pattern 211 and the second coil pattern 212 may have a planar spiral shape. As an example, in FIG. 1, the first coil pattern 211 may form at least one turn around the core 110 of the body 100 on a lower surface of the internal insulating layer IL, and the second coil pattern 212 may form at least one turn around the core 110 of the body 100 on an upper surface of the internal insulating layer IL.

The via 220 may penetrate through the internal insulating layer IL to electrically connect the first coil pattern 211 and the second coil pattern 212 to each other, and may be in contact with each of the first coil pattern 211 and the second coil pattern 212. Resultantly, the coil portion 200 according to the present exemplary embodiment may be formed of one coil generating a magnetic field in the thickness direction (T) of the body 100.

At least one of the first coil pattern 211, the second coil pattern 212, and the via 220 may include one or more conductive layers.

As an example, when the second coil pattern 212 and the via 220 are formed by plating, each of the second coil pattern 212 and the via 220 may include a seed layer of an electroless plating layer and an electroplating layer. Here, the electroplating layer may have a single-layer structure or have a multilayer structure. The electroplating layer having the multilayer structure may be formed in a conformal film structure in which another electroplating layer covers any one electroplating layer, or may be formed in a shape in which another electroplating layer is stacked on only one surface of anyone electroplating layer. The seed layer of the second coil pattern 212 and the seed layer of the via 220 may be formed integrally with each other, such that a boundary therebetween may not be formed, but are not limited thereto. The electroplating layer of the second coil pattern 212 and the electroplating layer of the via 220 may be formed integrally with each other, such that a boundary therebetween may not be formed, but are not limited thereto.

As another example, when the coil portion 200 is formed by separately forming the first coil pattern 211 and the second coil pattern 212 and then collectively stacking the first coil pattern 211 and the second coil pattern 212 beneath and on the internal insulating layer IL, respectively, the via 220 may include a high melting point metal layer and a low melting point metal layer having a melting point lower than that of the high melting point metal layer. Here, the low melting point metal layer may be formed of a solder including lead (Pb) and/or tin (Sn). At least a portion of the low melting point metal layer may be melted due to a pressure and a temperature at the time of the collective stacking, such that an inter-metallic compound (IMC) layer may be formed on a boundary between the low melting point metal layer and the second coil pattern 212.

The first coil pattern 211 and the second coil pattern 212 may protrude on the lower surface and the upper surface of the internal insulating layer IL, respectively, as an example. As another example, the first coil pattern 211 may be embedded in the lower surface of the internal insulating layer IL, such that a lower surface of the first coil pattern 211 may be exposed to the lower surface of the internal insulating layer IL, and the second coil pattern 212 may protrude on the upper surface of the internal insulating layer IL. In this case, concave portions may be formed in the lower surface of the first coil pattern 211, such that the lower surface of the internal insulating layer IL and the lower surface of the first coil pattern 211 may not be disposed to be coplanar with each other. As another example, the first coil pattern 211 may be embedded in the lower surface of the internal insulating layer IL, such that a lower surface of the first coil pattern 211 may be exposed to the lower surface of the internal insulating layer IL, and the second coil pattern 212 may be embedded in the upper surface of the internal insulating layer IL, such that an upper surface of the second coil pattern 212 may be exposed to the upper surface of the internal insulating layer IL.

End portions of the first coil pattern 211 and the second coil pattern 212 may be exposed to the first surface and the second surface of the body 100, respectively. The end portion of the first coil pattern 211 exposed to the first surface of the body 100 may be in contact with a first external electrode 300 to be described below, such that the first coil pattern 211 may be electrically connected to the first external electrode 300. The end portion of the second coil pattern 212 exposed to the second surface of the body 100 may be in contact with a second external electrode 400 to be described below, such that the second coil pattern 212 may be electrically connected to the second external electrode 400.

Each of the first coil pattern 211, the second coil pattern 212, and the via 220 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The internal insulating layer IL may be formed of an insulating material including at least one of a thermosetting insulating resin such as an epoxy resin, a thermoplastic insulating resin such as a polyimide resin, and a photosensitive insulating resin or be formed of an insulating material having a reinforcement material such as a glass fiber or an inorganic filler impregnated in such an insulating resin. As an example, the internal insulating layer IL may be formed of an insulating material such as prepreg, an Ajinomoto Build-up Film (ABF), FR-4, a Bismaleimide Triazine (BT) resin, a photoimageable dielectric (PID), or the like, but is not limited thereto.

As the inorganic filler, one or more materials selected from the group consisting of silica ($SiO_2$), alumina ($Al_2O_3$), silicon carbide (SiC), barium sulfate ($BaSO_4$), talc, clay, mica powder particles, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of the insulating material including the reinforcing material, the internal insulating layer IL may provide more excellent rigidity. When the internal insulating layer IL is formed of an insulating material that does not include a glass fiber, the internal insulating layer IL may be advantageous for decreasing an entire thickness of the coil portion 200. When the internal insulating layer IL is formed of the insulating material including the photosensitive insulating resin, the number of processes may be decreased, which is advantageous for decreasing a production cost, and a fine hole may be drilled.

The insulating film IF may be formed along surfaces of the first coil pattern 211, the internal insulating layer IL, and the second coil pattern 212. The insulating film IF may be provided in order to protect and insulate the first and second coil patterns 211 and 212, and may include any known insulating material such as parylene, or the like. The insulating material m included in the insulating film IF is not particularly limited, but may be any insulating material. The insulating film IF may be formed by a method such as vapor deposition, or the like, but is not limited thereto. That is, the insulating film IF may be formed by stacking insulating films on opposite surfaces of the internal insulating layer IL on which the first and second coil patterns 211 and 212 are formed.

Meanwhile, although not illustrated, the number of at least one of first and second coil patterns 211 and 212 may be plural. As an example, the coil portion 200 may include a plurality of first coil patterns 211, and may have a structure in which another first coil pattern is stacked on a lower surface of any one first coil pattern. In this case, an additional insulating layer may be disposed between the plurality of first coil patterns 211, and the plurality of first coil patterns 211 may be connected to each other by a connection via penetrating through the additional insulating layer. However, the coil portion is not limited thereto.

In the present disclosure, the coil portion 200 may be embedded in an asymmetric structure in the body 100. That is, the body 100 may include one region and the other region positioned symmetrically to each other in relation to the core 110 in the width direction of the body 100, and one region of the body may be formed at a width a greater than a width b of the other region of the body 100. This will be described. The width a may refer to a distance from the coil portion 200 to the third surface of the body 100, and the width b may refer to a distance from the coil portion 200 to the fourth surface of the body 100.

Referring to FIGS. 3 and 4, the second coil pattern 212 may format least one turn around the core 110, and may be formed to have different turns at both sides of the core 110 in the width direction of the body 100. That is, in FIG. 3, turns of the second coil pattern 212 formed on a left side of the core 110 may be more than those of the second coil pattern 212 formed on a right side of the core 110. In FIG. 4, which is a plan view, turns of the second coil pattern 212 formed on an upper side of the core 110 may be more than those of the second coil pattern 121 formed on a lower side of the core 110. Here, the third surface of the body 100 may correspond to a left side surface of the body 100 illustrated in FIG. 3 and an upper side surface of the body 100 illustrated in FIG. 4, and the fourth surface of the body 100 may correspond to a right side surface of the body 100 illustrated in FIG. 3 and a lower side surface of the body 100 illustrated in FIG. 3.

Due to such a difference between the turns of the coil portion, magnetic fluxes leaked to the third and fourth surfaces of the body 100 opposing each other in the width direction of the body 100 may be different from each other. In this case, an additional process of distinguishing the third and fourth surfaces of the coil component from each other may be required in consideration of electromagnetic interference with another electronic component in mounting the coil component on a printed circuit board, or the like.

In the present disclosure, the magnetic fluxes leaked to the third and fourth surfaces of the body 100 may be made uniform by forming the body at a relatively large thickness at an outer side of a region in which a larger number of turns of the coil portion are disposed and forming the body at a relatively small thickness at an outer side of a region in which a smaller number of turns of the coil portion are disposed. That is, one region of the body may be formed at the width a greater than the width b of the other region of the body to control the magnetic fluxes leaked to the third and fourth surfaces of the body 100 to be substantially the same as each other. Therefore, the coil component according to the present exemplary embodiment does not require the additional process of distinguishing the third and fourth surfaces from each other in being mounted on the printed circuit board, or the like.

A different between the width a of one region of the body and the width b of the other region of the body may exceed 0 and be 50 μm or less. When the difference between the width a and the width b is 0, the coil portion is embedded in a substantially symmetrical structure, and thus, the effect of the present exemplary embodiment described above may not be accomplished. When the difference between the width a and the width b exceeds 50 μm, an entire size of the coil component may be increased, which is disadvantageous for thinness of the coil component, and characteristics of the coil component such as a quality (Q) factor, and the like, may be deteriorated.

The external electrodes 300 and 400 may be disposed on the first and second surfaces of the body 100, respectively, and may be connected to the coil patterns 211 and 212, respectively. The external electrodes 300 and 400 may include the first external electrode 300 connected to the first coil pattern 211 and the second external electrode 400 connected to the second coil pattern 212. In detail, the first external electrode 300 may include a first connected portion 310 disposed on the first surface of the body 100 and connected to the end portion of the first coil pattern 211 and a first extending portion 320 extending from the first connected portion 310 to the sixth surface of the body 100. The second external electrode 400 may include a second connected portion 410 disposed on the second surface of the body 100 and connected to the end portion of the second coil pattern 212 and a second extending portion 420 extending from the second connected portion 410 to the sixth surface of the body 100. The first extending portion 320 and the second extending portion 420 each disposed on the sixth surface of the body 100 may be spaced apart from each other so that the first external electrode 300 and the second external electrode 400 are not in contact with each other.

The external electrodes 300 and 400 may electrically connect the coil component 1000 to the printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the extending portions 320 and 420 of the external electrodes 300 and 400 disposed on the sixth surface of the body 100 and connection portions of the printed circuit board may be electrically connected to each other by solders, or the like.

The external electrodes 300 and 400 may include a conductive material such as copper (Cu), aluminum (Al), silver (Ag), tin (Sn), gold (Au), nickel (Ni), lead (Pb), titanium (Ti), or alloys thereof, but are not limited thereto.

The external electrodes 300 and 400 may be formed by at least one of a paste printing method, a plating method, and a vapor deposition method. As an example, each of the external electrodes 300 and 400 may include a conductive resin layer formed by printing a conductive paste including conductive metal powder particles and a thermosetting resin and a conductive layer formed on the conductive resin layer by plating.

The shielding layer 500 may be disposed on the first to fifth surfaces of the body 100. That is, the shielding layer 500 may include a cap portion 510 disposed on the fifth surface of the body opposing the sixth surface of the body 100 and sidewall portions 521, 522, 523, and 524 disposed, respectively, on the first to fourth surfaces of the body connecting the sixth surface of the body 100 and the fifth surface of the body 100 to each other and connected to the cap portion 510. The shielding layer 500 according to the present exemplary embodiment may be disposed on all the surfaces of the body 100 except for the sixth surface of the body 100, which is a mounting surface of the coil component 1000 according to the present exemplary embodiment.

The first to fourth sidewall portions 521, 522, 523, and 524 may be formed integrally with one another. That is, the first to fourth sidewall portions 521, 522, 523, and 524 may be formed by the same process, such that boundaries therebetween may not be formed. As an example, the first to fourth sidewall portions 521, 522, 523, and 524 may be formed integrally with one another by stacking a single shielding sheet having an insulating film and a shielding film on the first to fourth surfaces of the body 100. Here, the insulating film of the shielding sheet may correspond to an insulating layer 600 to be described below. Meanwhile, in the above example, a cross section of a region in which any one sidewall portion and another sidewall portion are connected to each other may be formed as a curved surface due to physical processing of the shielding sheet. As another example, when the first to fourth sidewall portions 521, 522, 523, and 524 are formed by performing vapor deposition such as sputtering, or the like, on the first to fourth surfaces of the body 100 on which the insulating layer 600 is formed, the first to fourth sidewall portions 521, 522, 523, and 524 may be formed integrally with one another. As another example, when the first to fourth sidewall portions 521, 522, 523, and 524 are formed by performing plating on the first to fourth surfaces of the body 100 on which the insulating layer 600 is formed, the first to fourth sidewall portions 521, 522, 523, and 524 may be formed integrally with one another.

The cap portion 510 and the sidewall portions 521, 522, 523, and 524 may be formed integrally with each other. That is, the cap portion 510 and the sidewall portions 521, 522, 523, and 524 may be formed by the same process, such that boundaries therebetween may not be formed. As an example, the cap portion 510 and the sidewall portions 521, 522, 523, and 524 may be formed integrally with each other by attaching a single shielding sheet including an insulating film and a shielding film to the first to fifth surfaces of the body 100. Here, the insulating film of the shielding sheet may correspond to an insulating layer 600 to be described below. As another example, the cap portion 510 and the first to fourth sidewall portions 521, 522, 523, and 524 may be formed integrally with one another by performing a vapor deposition process such as sputtering on the first to fifth surfaces of the body 100 on which the insulating layer 600 is formed. As another example, the cap portion 510 and the first to fourth sidewall portions 521, 522, 523, and 524 may be formed integrally with one another by performing a plating process on the first to fifth surfaces of the body 100 on which the insulating layer 600 is formed.

Each of connected portions between the cap portion 510 and the sidewall portions 521, 522, 523, and 524 may have a curved surface shape. As an example, when the shielding sheet is processed to correspond to a shape of the body and is attached to the first to fifth surfaces of the body 100, a cross section of a region in which the cap portion 510 and the sidewall portions 521, 522, 523, and 524 are connected to each other may be formed as a curved surface. As another example, when the shielding layer 500 is formed on the first to fifth surfaces of the body 100 on which the insulating layer 600 is formed, by the vapor deposition such as the sputtering, a cross section of a region in which the cap portion 510 and the sidewall portions 521, 522, 523, and 524 are connected to each other may be formed as a curved surface. As another example, when the shielding layer 500 is formed on the first to fifth surfaces of the body 100 on which the insulating layer 600 is formed, by the plating, a cross section of a region in which the cap portion 510 and the sidewall portions 521, 522, 523, and 524 are connected to each other may be formed as a curved surface.

Each of the first to fourth sidewall portions 521, 522, 523, and 524 may have one end connected to the cap portion 510 and the other end opposing the one end, and the other end of each of the first to fourth sidewall portions 521, 522, 523, and 524 may be spaced apart from the sixth surface of the body 100 by a predetermined distance by a gap portion G to be described below.

The shielding layer 500 may be formed at a thickness of 10 nm to 100 μm. When the thickness of the shielding layer 500 is less than 10 nm, a shielding effect may not substantially exist, and when the thickness of the shielding layer 500 exceeds 100 μm, an entire length, width, and thickness of the coil component may be increased, which is disadvantageous for thinness of the coil component.

The shielding layer 500 may include at least one of a conductor and a magnetic material. As an example, the conductor may be a metal or an alloy including one or more selected from the group consisting of copper (Cu), silver (Ag), gold (Au), aluminum (Al), iron (Fe), silicon (Si), boron (B), chromium (Cr), niobium (Nb), and nickel (Ni), and may be Fe—Si or Fe—Ni. In addition, the shielding layer 500 may include one or more selected from the group consisting of ferrite, permalloy, and an amorphous ribbon. The shielding layer 500 may be, for example, a copper plating layer, but is not limited thereto. The shielding layer 500 may have a multilayer structure. As an example, the shielding layer 500 may be formed in a double layer structure including a conductor layer and a magnetic layer formed on the conductor layer, a double layer structure including a first conductor layer and a second conductor layer formed on the first conductor layer, or a structure of a plurality of conductor layers. Here, the first and second conductor layers may include different conductors, but may also include the same conductor.

The shielding layer 500 may include two or more fine structures separated from each other. As an example, when each of the cap portion 510 and the sidewall portions 521, 522, 523, and 524 is formed of an amorphous ribbon sheet separated into a plurality of pieces, each of the cap portion 510 and the sidewall portions 521, 522, 523, and 524 may include a plurality of fine structures separated from each other. As another example, when each of the cap portion 510 and the sidewall portions 521, 522, 523, and 524 is formed by the sputtering, each of the cap portion 510 and the sidewall portions 521, 522, 523, and 524 may include a plurality of fine structures distinguished from each other by grain boundaries.

The insulating layer 600 may be disposed between the body 100 and the shielding layer 500 to electrically isolate m the shielding layer 500 from the body 100 and the external electrodes 300 and 400. In the present exemplary embodiment, the insulating layer 600 may be disposed on the first to fifth surfaces of the body 100. Since the connected portions 310 and 410 of the external electrodes 300 and 400 are formed on the first and second surfaces of the body 100, respectively, the connected portions 310 and 410 of the external electrodes 300 and 400, the insulating layer 600, and the sidewall portions 521 and 522 of the shielding layer 500 may be sequentially disposed on each of the first and second surfaces of the body 100. Since the connected portions 310 and 410 of the external electrodes 300 and 400 are not formed on the third and fourth surfaces of the body 100, respectively, the insulating layer 600, and the sidewall portions 523 and 524 of the shielding layer 500 may be sequentially disposed on each of the third and fourth surfaces of the body 100.

The insulating layer 600 may include a thermoplastic resin such as polystyrenes, vinyl acetates, polyesters, polyethylenes, polypropylenes, polyamides, rubbers, or acryls, a thermosetting resin such as phenols, epoxies, urethanes, melamines, or alkyds, a photosensitive resin, parylene, $SiO_x$, or $SiN_x$.

The insulating layer 600 may have an adhesive function. As an example, when the insulating layer 600 and the shielding layer 500 are formed of a shielding sheet including an insulating film and a shielding film, the insulating film of the shielding sheet may include an adhesive component to adhere the shielding film to surfaces of the body 100. In this case, an adhesive layer may separately be formed between one surface of the insulating layer 600 and the body 100. However, when the insulating layer 600 is formed using an insulating film in a B-stage, a separate adhesive layer may not be formed on one surface of the insulating layer 600.

The insulating layer 600 may be formed by applying a liquid-phase insulating resin to the surfaces of the body 100, stacking an insulating film such as a dry film (DF) on the surfaces of the body 100, or forming an insulating resin on the surfaces of the body 100 by vapor deposition. The insulating film may be an ABF that does not include a photosensitive insulating resin, a polyimide film, or the like.

The insulating layer 600 may be formed in a thickness range of 10 nm to 100 μm. When a thickness of the insulating layer 600 is less than 10 nm, characteristics of the coil component such as a Q factor, or the like, may be deteriorated, and when a thickness of the insulating layer 600 exceeds 100 μm, an entire length, width, and thickness of the coil component may be increased, which is disadvantageous for thinness of the coil component.

The cover layer 700 may be disposed on the shielding layer 500 in order to prevent the shielding layer 500 from being electrically connected to another external electronic component and/or the external electrodes 300 and 400. The cover layer 700 may cover the cap portion 510 and the first to fourth sidewall portions 521, 522, 523, and 524.

The cover layer 700 may include at least one of a thermoplastic resin such as polystyrenes, vinyl acetates, polyesters, polyethylenes, polypropylenes, polyamides, rubbers, or acryls, a thermosetting resin such as phenols, epoxies, urethanes, melamines, or alkyds, a photosensitive insulating resin, parylene, $SiO_x$, and $SiN_x$.

As an example, the cover layer 700 may be formed simultaneously with the insulating layer 600 and the shielding layer 500 by disposing an insulating film of a shielding sheet including the insulating film, a shielding film, and a cover film to face the body 100 and then stacking the shielding sheet on the body 100. As another example, the cover layer 700 may be formed by stacking a cover film on the shielding layer 500 formed on the body 100. As another example, the cover layer 700 may be formed on the first to fifth surfaces of the body 100 by forming an insulating material by vapor deposition such as chemical vapor deposition (CVD), or the like.

The cover layer 700 may have an adhesive function. As an example, the cover film may include an adhesive component to be bonded to the shielding film in the shielding sheet including the insulating film, the shielding film, and the cover film.

The cover layer 700 may be formed in a thickness range of 10 nm to 100 μm. When a thickness of the cover layer 700 is less than 10 nm, an insulation property may be weak, such that a short-circuit between an external electronic component and the coil component may occur, and when a thickness of the cover layer 700 exceeds 100 μm, an entire length, width, and thickness of the coil component may be increased, which is disadvantageous for thinness of the coil component.

The sum of the thicknesses of the insulating layer 600, the shielding layer 500, and the cover layer 700 may exceed 30 nm and be 100 μm or less. When the sum of the thicknesses of the insulating layer 600, the shielding layer 500, and the cover layer 700 is less than 30 nm, a problem such as an electrical short-circuit, a decrease in characteristics of the coil component such as a Q factor, and the like, may occur, and when the sum of the thicknesses of the insulating layer 600, the shielding layer 500, and the cover layer 700 exceeds 100 μm, the entire length, width, and thickness of the coil component may be increased, which is disadvantageous for thinness of the coil component.

Meanwhile, in forming the cover layer 700, the cover layer 700 may be formed to expose the other ends of the sidewall portions 521, 522, 523, and 524 due to tolerances or characteristics of a forming method. In this case, it is likely m that the shielding layer 500 will be electrically connected to the external electrodes 300 and 400. Therefore, in the present disclosure, the gap portion G between the sidewall portions 521, 522, 523, and 524 and the sixth surface of the body 100 may solve the problem described above.

The gap portion G may be formed in the insulating layer 600, the sidewall portions 521, 522, 523, and 524, and the cover portion 700 to expose portions of walls of the body 100. In the present exemplary embodiment, the connected portions 310 and 410 of the external electrodes 300 and 400 may be formed on the first and second surfaces of the body 100, respectively. Therefore, the gap portion G may externally expose at least portions of the connected portions 310 and 410 and the third and fourth surfaces of the body 100.

The gap portion G may allow the other end of each of the sidewall portions 521, 522, 523, and 524 to be spaced apart from the sixth surface of the body 100, which is the mounting surface of the coil component 1000. More specifically, lower surfaces of the extending portions 320 and 420 of the external electrodes 300 and 400 may be spaced apart from the sixth surface of the body 100 by a predetermined distance. As an example, when the coil component 1000 is mounted on the printed circuit board, or the like, solders, or the like, may go up along the connected portions 310 and 410. However, the gap portion G may be formed on the other ends of the sidewall portions 521, 522, 523, and 524 to prevent the sidewall portions 521, 522, 523, and 524 and the external electrodes 300 and 400 from being electrically connected to each other by the solders, or the like.

Meanwhile, although not illustrated in FIGS. 1 through 3, a separate additional insulating layer distinguished from the insulating layer 600 may be formed on regions of the first to sixth surfaces of the body 100 on which the external electrodes 300 and 400 are not formed. That is, the separate additional insulating layer distinguished from the insulating layer 600 may be formed on the third to fifth surfaces of the body 100 and on a region of the sixth surface of the body on which the extending portions 320 and 420 are not formed. In this case, the insulating layer 600 according to the present exemplary embodiment may be formed on the surfaces of the body 100 to be in contact with the additional insulating layer. The additional insulating layer may serve as a plating resist in forming the external electrodes 300 and 400 by plating, but is not limited thereto.

Since the insulating layer 600 and the cover layer 700 according to the present disclosure are disposed in the coil component itself, the insulating layer 600 and the cover layer 700 may be distinguished from a molding material molding the coil component and the printed circuit board in a process of mounting the coil component on the printed circuit board. Therefore, the insulating layer 600 according to the present disclosure may not be in contact with the printed circuit board, and may not be supported and fixed by the printed circuit board unlike the molding material. In addition, unlike the molding material surrounding connection members such as solder balls connecting the coil component and the printed circuit board to each other, the insulating layer 600 and the cover layer 700 according to the present disclosure may not be formed to surround the connection members. In addition, since the insulating layer 600 according to the present disclosure is not the molding material formed by heating an epoxy molding compound (EMC), or the like, moving the EMC onto the printed circuit board, and then hardening the EMC, generation of voids at the time of forming the molding material, occurrence of warpage of the printed circuit board due to a difference between a coefficient of thermal expansion (CTE) of the molding material and a CTE of the printed circuit board, and the like, need not to be considered.

In addition, since the shielding layer 500 according to the present disclosure is disposed in the coil component itself, the shielding layer 500 may be distinguished from a shield can coupled to the printed circuit board in order to shield electromagnetic interference (EMI), or the like, after the coil component is mounted on the printed circuit board. As an example, it may not be considered to connect the shielding layer 500 according to the present disclosure to a ground layer of the printed circuit board, unlike the shield can.

In the coil component according to the present exemplary embodiment, the shielding layer 500 is formed in the coil component itself, but the gap portion G may be formed in the sidewall portions 521, 522, 523, and 524, to prevent an electrical short-circuit between the shielding layer 500 and the external electrodes 300 and 400 while blocking leaked magnetic fluxes generated in the coil component. In accordance with thinness and performance improvement of an electronic device, the total number of electronic components included in the electronic device and a distance between adjacent electronic components has decreased. However, in the present disclosure, the respective coil components themselves may be shielded, such that leaked magnetic fluxes generated in the respective coil components may be more efficiently blocked, which may be more advantageous for thinness and performance improvement of the electronic device. In addition, an amount of effective magnetic material in a shielding region may be increased as compared to a case of using the shield can, and characteristics of the coil component may thus be improved.

In addition, in the coil component according to the present exemplary embodiment, the magnetic fluxes leaked to the third and fourth surfaces of the body 100 opposing each other in the width direction may be made substantially the same as each other, such that directivity does not need to be considered in mounting the coil component on the printed circuit board, or the like. Therefore, the coil component may be more simply and efficiency mounted in a mounting process, a packaging process, or the like.

Second Exemplary Embodiment

Figure 5:
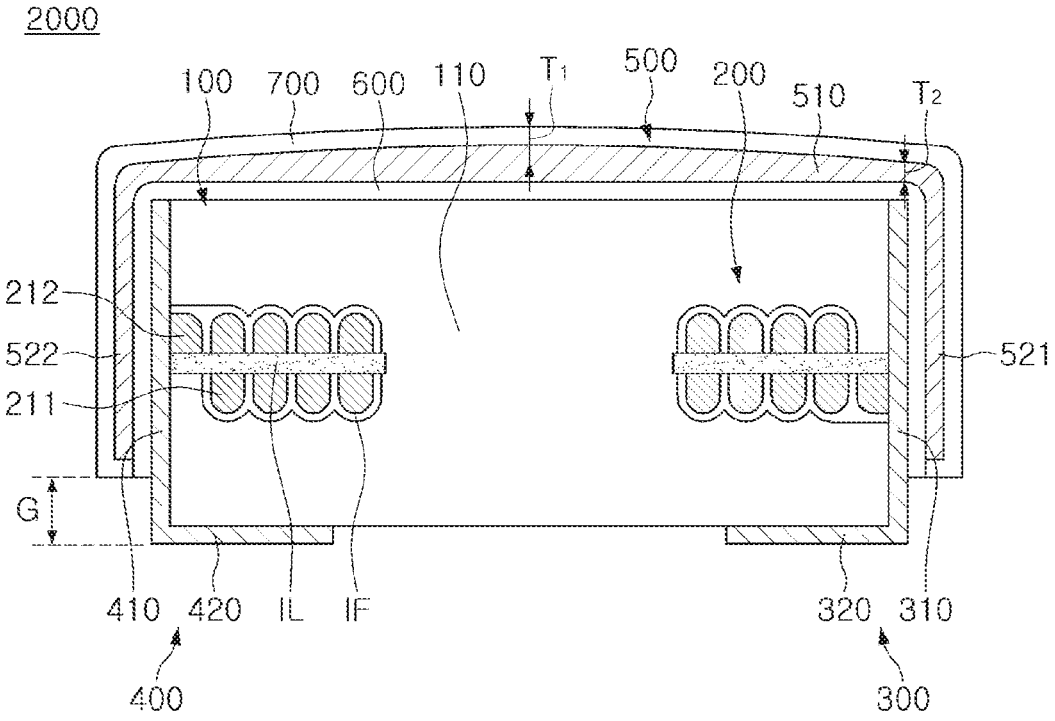
FIG. 5 is a cross-sectional view illustrating a coil component according to a second exemplary embodiment in the present disclosure and corresponding to the cross-sectional view taken along line I-I' of FIG. 1.

FIG. 5 is a cross-sectional view illustrating a coil component according to a second exemplary embodiment in the present disclosure and corresponding to the cross-sectional view taken along line I-I' of FIG. 1.

Referring to FIGS. 1 through 5, a coil component 2000 according to the present exemplary embodiment may be different in a cap portion 510 from the coil component 1000 according to the first exemplary embodiment in the present disclosure. Therefore, in describing the present exemplary embodiment, only the cap portion 510 different from that of the first exemplary embodiment in the present disclosure will be described. The description in the first exemplary embodiment in the present disclosure may be applied to other components of the present exemplary embodiment as it is.

Referring to FIG. 5, a central portion of the cap portion 510 may be formed at a thickness $T_1$ greater than a thickness $T_2$ of an outer side portion thereof. This will be described in detail.

The respective coil patterns 211 and 212 constituting the coil portion 200 according to the present exemplary embodiment may form a plurality of turns from the center of the internal insulating layer IL to an outer side of the internal insulating layer IL on opposite surfaces of the internal insulating layer IL, respectively, and may be stacked in the thickness direction (T) of the body 100 and be connected to each other by the via 220 (shown in FIG. 3). Resultantly, in the coil component 2000 according to the present exemplary embodiment, a magnetic flux density may be highest at a central portion of a length direction (L)-width direction (W) plane of the body 100 perpendicular to the thickness direction (T) of the body 100. Therefore, in the present exemplary embodiment, in forming the cap portion 510 disposed on the fifth surface of the body 100 substantially parallel with the length direction (L)-width direction (W) plane of the body 100, the central portion of the cap portion 510 may be formed at the thickness $T_1$ greater than the thickness $T_2$ of the outer side portion thereof in consideration of a magnetic flux density distribution on the length direction (L)-width direction (W) plane of the body 100.

In this way, in the coil component 2000 according to the present exemplary embodiment, a leaked magnetic flux may be more efficiency decreased depending on the magnetic flux density distribution.

Third Exemplary Embodiment

Figure 6:
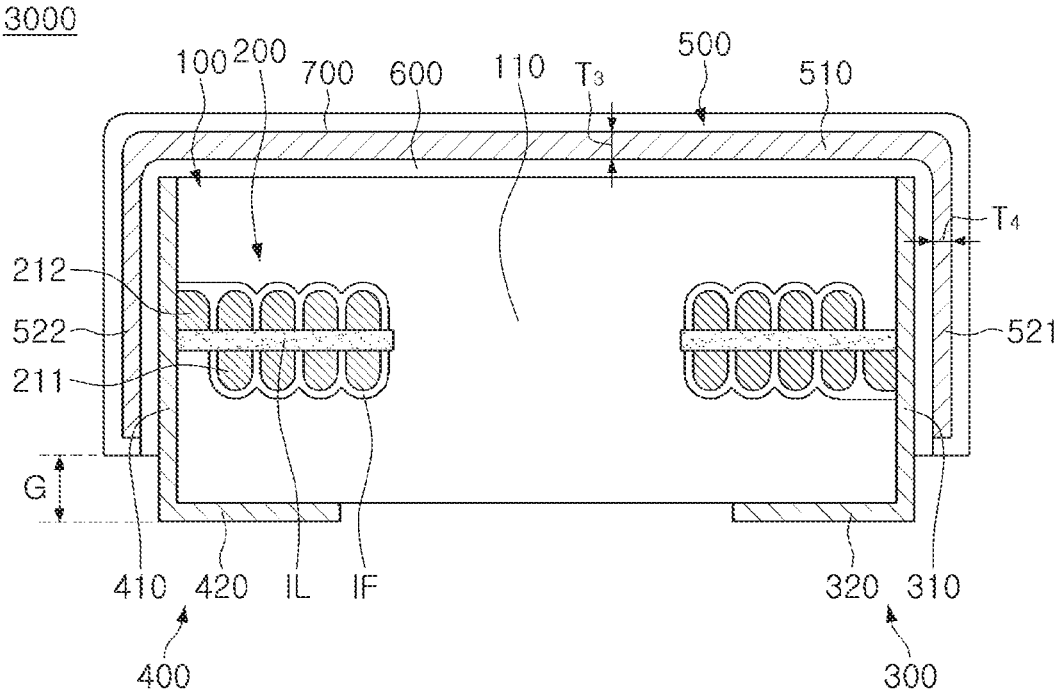
FIG. 6 is a cross-sectional view illustrating a coil component according to a third exemplary embodiment in the present disclosure and corresponding to the cross-sectional view taken along line I-I' of FIG. 1.
Figure 7:
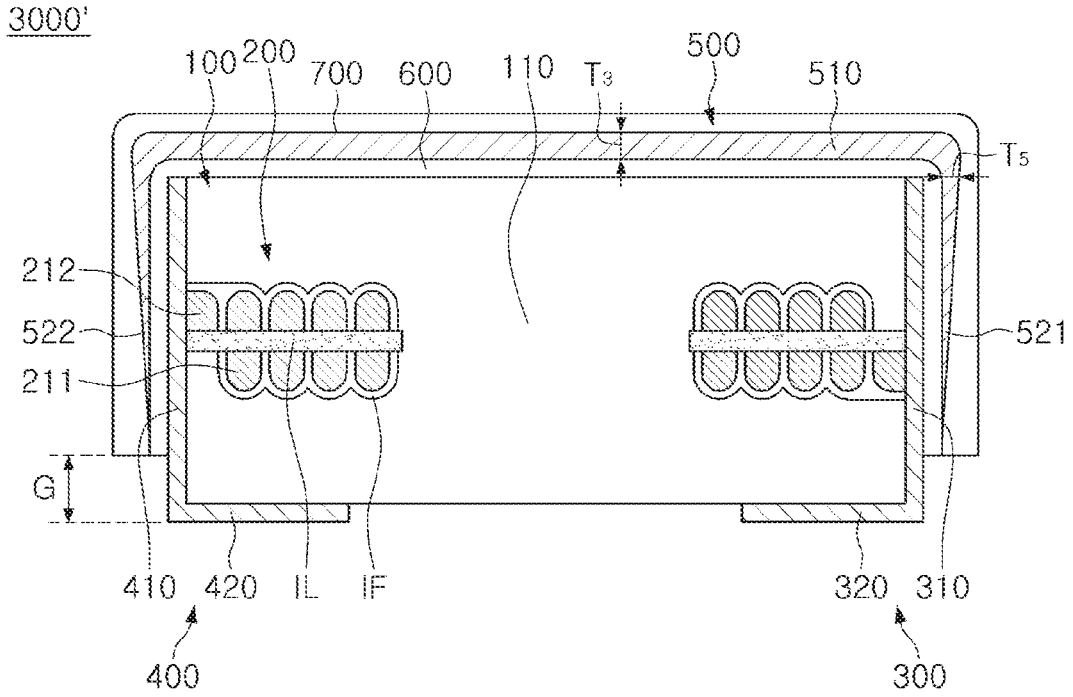
FIG. 7 is a cross-sectional view illustrating a coil component according to a modified example of a third exemplary embodiment in the present disclosure and corresponding to the cross-sectional view taken along line I-I' of FIG. 1

FIG. 6 is a cross-sectional view illustrating a coil component according to a third exemplary embodiment in the present disclosure and corresponding to the cross-sectional view taken along line I-I' of FIG. 1. FIG. 7 is a cross-sectional view illustrating a coil component according to a modified example of a third exemplary embodiment in the present disclosure and corresponding to the cross-sectional view taken along line I-I' of FIG. 1

Referring to FIGS. 1 through 7, a coil component 3000 according to the present exemplary embodiment and a coil component 3000' according to the modified example of the present exemplary embodiment may be different in a cap portion 510 and sidewall portions 521, 522, 523, and 524 from the coil components 1000 and 2000 according to the first and second exemplary embodiments in the present disclosure. Therefore, in describing the present exemplary embodiment and the modified example of the present exemplary embodiment, only the cap portion 510 and the sidewall portions 521, 522, 523, and 524 different from those of the first and second exemplary embodiments in the present disclosure will be described. The description in the first and second exemplary embodiments in the present disclosure may be applied to other components of the present exemplary embodiment and the modified example of the present exemplary embodiment as it is.

Referring to FIG. 6, a thickness $T_3$ of the cap portion 510 may be greater than a thickness $T_4$ of each of the sidewall portions 521, 522, 523, and 524.

As described above, the coil portion 200 may generate a magnetic field in the thickness direction (T) of the body 100. Resultantly, a magnetic flux leaked in the thickness direction (T) of the body 100 may be greater than those leaked in other directions. Therefore, the cap portion 510 disposed on the fifth surface of the body 100 perpendicular to the thickness direction (T) of the body 100 may be formed at a thickness greater than that of each of the sidewall portions 521, 522, 523, and 524 disposed on walls of the body 100 to more efficiently decrease the leaked magnetic flux.

As an example, the cap portion 510 may be formed at the thickness greater than that of each of the sidewall portions 521, 522, 523, and 524 by forming a shielding layer on the first to fifth surfaces of the body 100 using a shielding sheet including an insulating film and a shielding film and additionally forming a shielding material on only the fifth surface of the body 100. As another example, the cap portion 510 may be formed at the thickness greater than that of each of the sidewall portions 521, 522, 523, and 524 by disposing the body 100 so that the fifth surface of the body 100 faces a target and then performing sputtering for forming the shielding layer 500. However, the scope of the present exemplary embodiment is not limited to the example described above.

Referring to FIG. 7, a thickness $T_5$ of one end of each of the sidewall portions 521, 522, 523, and 524 may be greater than that of the other end of the sidewall portion 520.

As an example, when the cap portion 510 and the sidewall portions 521, 522, 523, and 524 are formed by plating, a current density may be concentrated due to edged shapes in edge portions of the body 100 at which the fifth surface of the body 100 and the first to fourth surfaces of the body 100 are connected to each other, that is, regions in which one end of the sidewall portion 520 is formed. Therefore, one end of the sidewall portion 520 may be formed at a thickness relatively greater than that of the other end of the sidewall portion 520. As another example, one end of the sidewall portion 520 may be formed at a thickness relatively greater than that of the other end of the sidewall portion 520 by disposing the body 100 so that the fifth surface of the body 100 faces a target and then performing sputtering for forming the shielding layer 500. However, the scope of the present modified example is not limited to the example described above.

Fourth Exemplary Embodiment

Figure 8:
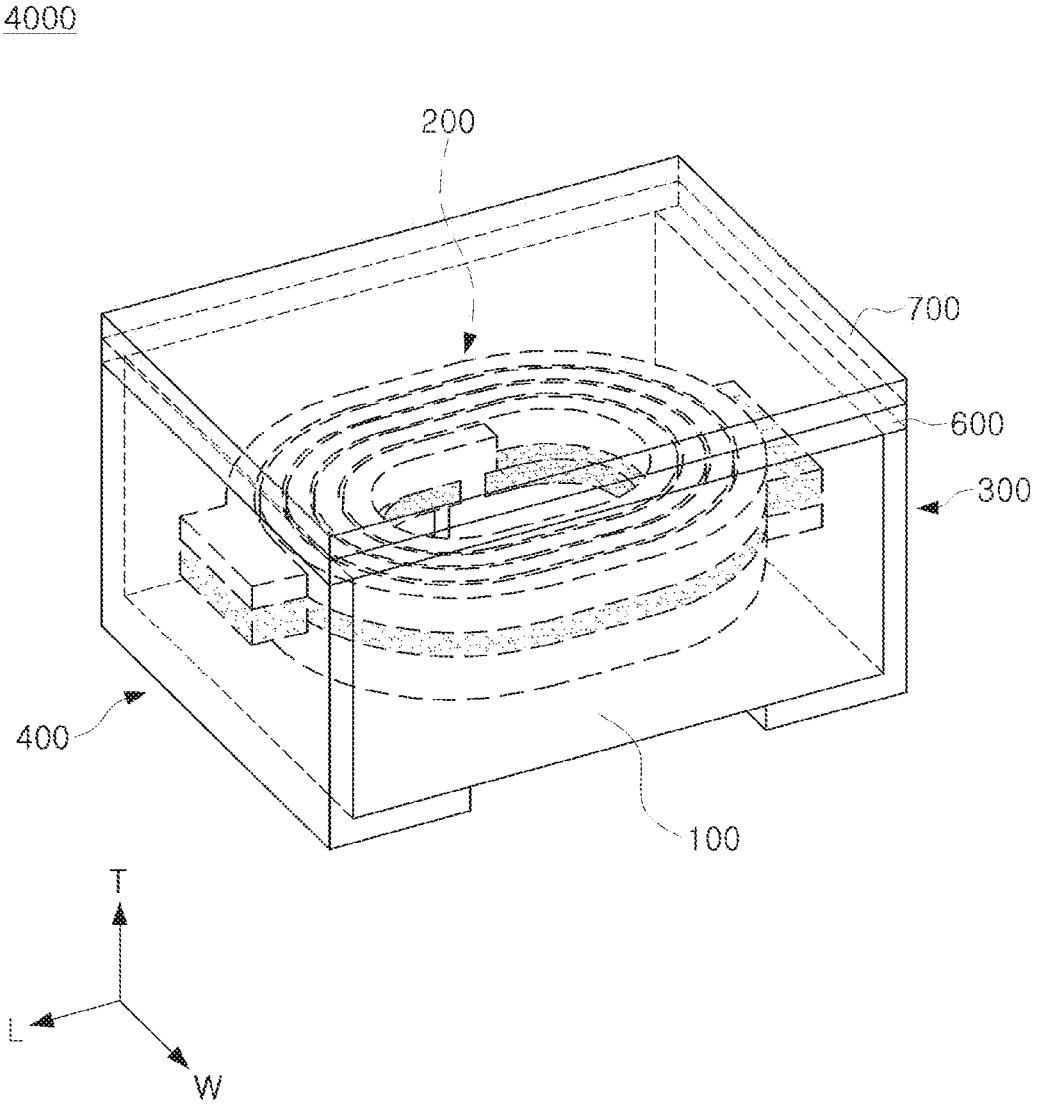
FIG. 8 is a schematic perspective view illustrating a coil component according to a fourth exemplary embodiment in the present disclosure.
Figure 9:
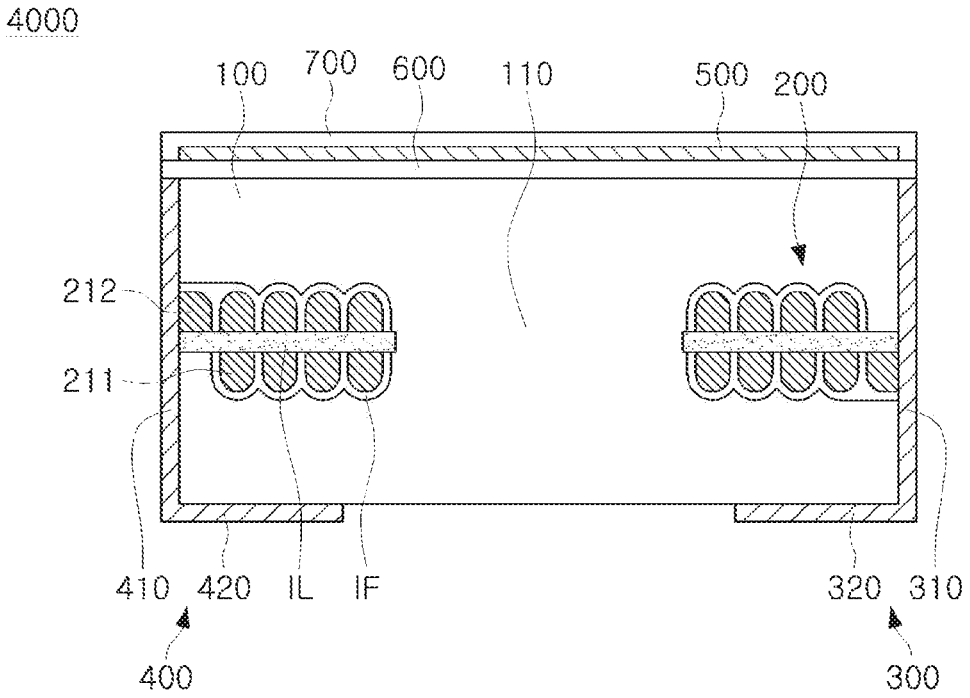
FIG. 9 is a cross-sectional view taken along an LT plane of FIG. 8.

FIG. 8 is a schematic perspective view illustrating a coil component according to a fourth exemplary embodiment in the present disclosure. FIG. 9 is a cross-sectional view taken along an LT plane of FIG. 8.

Referring to FIGS. 1 through 9, a coil component 4000 according to the present exemplary embodiment may be different in a structure of a shielding layer 500 from the coil components 1000, 2000, and 3000 according to the first to third exemplary embodiments in the present disclosure. Therefore, in describing the present exemplary embodiment, only the shielding layer 500 different from those of the first to third exemplary embodiments in the present disclosure will be described. The description in the first to third exemplary embodiments in the present disclosure may be applied to other components of the present exemplary embodiment as it is.

In detail, in the present exemplary embodiment, the shielding layer 500 may include only a cap portion 510.

As described above in another exemplary embodiment in the present disclosure, in the coil portion 200, the largest leaked magnetic flux may be generated in the thickness direction (T) of the body 100. Therefore, in the present exemplary embodiment, the shielding layer 500 may be formed on only the fifth surface of the body 100 perpendicular to the thickness direction (T) of the body 100 to more simply and efficiently block the leaked magnetic flux.

Meanwhile, although a case in which the external electrodes 300 and 400 used in the present disclosure are L-shaped electrodes including the connected portions 310 and 410 and the extending portions 320 and 420, respectively, has been described in the exemplary embodiments in the present disclosure described above, this is only for convenience of explanation, and the external electrodes 300 and 400 may be modified into various forms. As an example, the external electrodes 300 and 400 are not formed on the first and second surfaces of the body 100, respectively, but may be formed on only the sixth surface of the body 100 and be connected to the coil portion 200 through via electrodes, or the like. As another example, the external electrodes 300 and 400 may be ⊏-shaped electrodes including connected portions formed on the first and second surfaces of the body, respectively, extending portions extending from the connected portions and disposed on the sixth surface of the body 100, and band portions extending from the connected portions and disposed on the fifth and sixth surfaces of the body 100. As another example, the external electrodes 300 and 400 may be five-sided electrodes including connected portions formed on the first and second surfaces of the body 100, respectively, extending portions extending from the connected portions and disposed on the sixth surface of the body 100, and band portions extending from the connected portions and disposed on the third to fifth surfaces of the body 100.

In addition, a case in which a structure of the coil portion is a thin film type coil in which the coil patterns are formed by the plating, the sputtering, or the like, has been described in the exemplary embodiments in the present disclosure described above, but a multilayer coil and a vertical disposition type coil may also be included in the scope of the present disclosure. The multilayer coil refers to a coil formed by applying a conductive paste to the respective magnetic sheets and then stacking, hardening, and sintering a plurality of magnetic sheets to which the conductive paste is applied. The vertical disposition type coil refers to a coil of which a coil pattern has a turn formed perpendicular to a lower surface of a coil component, which is a mounting surface.

As set forth above, according to an exemplary embodiment in the present disclosure, a leaked magnetic flux of the coil component may be decreased.

In addition, magnetic fluxes leaked to opposite end surfaces may be made relatively uniform.

While exemplary embodiments have been shown and described above, it will be apparent to those skilled in the art that modifications and variations could be made without departing from the scope of the present invention as defined by the appended claims.

What is claimed is:

1. A coil component comprising:

a body having a first surface and a second surface opposing each other in one direction and including a core extending in the one direction;

a coil portion embedded in the body and having at least one turn around the core;

a shielding layer disposed on the second surface of the body; and an insulating layer disposed between the body and the shielding layer, an external electrode disposed at least on the first surface of the body and connected to the coil portion, wherein a first distance from the coil portion to a third surface of the body is greater than a second distance from the coil portion to a fourth surface of the body, the third and fourth surfaces opposing each other and having the core disposed therebetween, turns of the coil portion disposed between the third surface of the body and the core are more than those of the coil portion disposed between the fourth surface of the body and the core, and the insulating layer covers at least a portion of the external electrode so that the portion of the external electrode is disposed between the body and the insulating layer.

2. The coil component of claim 1, wherein a difference between the first and second distances exceeds 0 and is 50 μm or less.

3. The coil component of claim 1, wherein a thickness of the shielding layer is greater in a central portion of the second surface of the body than in an outer side portion of the second surface of the body.

4. The coil component of claim 1, wherein the shielding layer includes at least one of a conductor and a magnetic material.

5. The coil component of claim 1, further comprising a cover layer covering the shielding layer.

6. The coil component of claim 1, wherein the shielding layer includes:

a cap portion disposed on the second surface of the body; and a sidewall portion connected to the cap portion and disposed on a wall of the body connecting the first surface of the body and the second surface of the body to each other.

7. The coil component of claim 6, wherein the cap portion has a thickness greater than that of the sidewall portion.

8. The coil component of claim 6, wherein one end of the sidewall portion connected to the cap portion has a thickness greater than that of the other end of the sidewall portion.

9. The coil component of claim 6, further comprising a cover layer covering the sidewall portion and the cap portion.

10. The coil component of claim 6, wherein the sidewall portion is spaced apart from the first surface.

11. A coil component comprising:

a body in which a core is disposed;

a coil portion having at least one turn around the core;

an external electrode disposed on one surface of the body and connected to the coil portion;

an insulating layer formed on surfaces of the body except for the one surface of the body; and a shielding layer formed on the insulating layer to be disposed on the surfaces of the body except for the one surface of the body, wherein a first distance from one side surface of the body to an outermost turn of the coil portion is greater than a second distance from the other side surface of the body opposing the one side surface of the body to an outermost turn of the coil portion, turns of the coil portion disposed between the one side surface of the body and the core are more than those of the coil portion between the other side surface of the body and the core, and a difference between the first and second distances exceeds 0 and is 50 μm or less.

12. The coil component of claim 11, wherein the shielding layer includes at least one of a conductor and a magnetic material.

13. A coil component comprising:

a body having a first surface and a second surface opposing each other in one direction and including a core extending in the one direction;

a coil portion embedded in the body and having at least one turn around the core; and an external electrode disposed at least on the first surface of the body and connected to the coil portion, wherein a first distance from the coil portion to a third surface of the body is greater than a second distance from the coil portion to a fourth surface of the body, the third and fourth surfaces opposing each other and having the core disposed therebetween, turns of the coil portion disposed between the third surface of the body and the core are more than those of the coil portion disposed between the fourth surface of the body and the core, and a difference between the first and second distances exceeds 0 and is 50 μm or less.

14. The coil component of claim 13, further comprising:

a shielding layer disposed on the second surface of the body; and an insulating layer disposed between the body and the shielding layer.

15. The coil component of claim 14, wherein a thickness of the shielding layer is greater in a central portion of the second surface of the body than in an outer side portion of the second surface of the body.

16. The coil component of claim 14, wherein the shielding layer includes at least one of a conductor and a magnetic material.

17. The coil component of claim 14, further comprising a cover layer covering the shielding layer.

18. The coil component of claim 14, wherein the shielding layer includes:

a cap portion disposed on the second surface of the body; and a sidewall portion connected to the cap portion and disposed on a wall of the body connecting the first surface of the body and the second surface of the body to each other.

19. The coil component of claim 18, wherein the cap portion has a thickness greater than that of the sidewall portion.

20. The coil component of claim 18, wherein one end of the sidewall portion connected to the cap portion has a thickness greater than that of the other end of the sidewall portion.

* * * * *